United States Patent [19]

Moreno et al.

[11] 4,224,130

[45] Sep. 23, 1980

[54] ELECTROLYTIC DIAPHRAGM CELL

[75] Inventors: Carlos M. Moreno; Robert D. Bridges, both of Baton Rouge, La.

[73] Assignee: The Dow Chemical Company, Midland, Mich.

[21] Appl. No.: 877,060

[22] Filed: Feb. 13, 1978

Related U.S. Application Data

[63] Continuation of Ser. No. 777,868, Mar. 15, 1977, abandoned.

[51] Int. Cl.[2] ..... C25B 13/02; C25B 13/08; C25B 1/16; C25B 1/26

[52] U.S. Cl. ..... 204/266; 204/252; 204/263; 204/296

[58] Field of Search ..... 204/266, 252, 253, 78, 204/263, 6, 296, 93

[56] References Cited

U.S. PATENT DOCUMENTS

| | | | |
|---|---|---|---|
| 2,944,956 | 7/1960 | Blue et al. | 204/266 |
| 3,312,614 | 4/1967 | Schick | 204/266 |
| 3,450,623 | 6/1969 | Joo et al. | 204/296 X |
| 3,450,650 | 6/1969 | Murata | 204/296 X |
| 3,627,859 | 12/1971 | Mesite et al. | 264/49 |
| 3,736,322 | 5/1973 | Helber et al. | 204/266 |
| 3,752,757 | 8/1973 | Stephenson et al. | 204/256 |
| 3,944,477 | 3/1976 | Argade | 204/266 |
| 4,089,758 | 5/1978 | McAloon | 204/252 X |
| 4,098,672 | 7/1978 | Riley | 204/296 |

FOREIGN PATENT DOCUMENTS

| | | | |
|---|---|---|---|
| 681132 | 3/1964 | Canada | 204/296 |
| 725704 | 1/1966 | Canada | 204/296 |
| 2139646 | 2/1972 | Fed. Rep. of Germany | 204/296 |
| 1081046 | 8/1967 | United Kingdom | 204/296 |
| 1205943 | 9/1970 | United Kingdom | 204/296 |
| 1401290 | 7/1975 | United Kingdom | 204/296 |

*Primary Examiner*—Arthur C. Prescott

[57] ABSTRACT

An electrolytic diaphragm cell to produce chlorine and an alkali metal hydroxide from an aqueous alkali metal chloride solution is disclosed. The cell has anode and cathodes spaced apart by a porous, electrolyte permeable polytetrafluoroethylene diaphragm with a thickness of about 5 to about 100 mils and an average pore size of about 0.1 to about 100 microns.

12 Claims, No Drawings

ELECTROLYTIC DIAPHRAGM CELL

CROSS REFERENCE TO RELATED APPLICATION

This is a continuation, of application Ser. No. 777,868 filed Mar. 15, 1977, now abandoned.

BACKGROUND OF THE INVENTION

This invention pertains to the electrolytic production of chlorine in a diaphragm cell and more in particular to an electrolytic cell containing an organic diaphragm.

Gaseous chlorine has long been produced from sodium chloride in an electrolytic cell having an anode positioned within an anode chamber and a cathode in a cathode department spaced apart from the anode compartment by an ion and liquid permeable diaphragm, such as one at least partially formed of asbestos. Other electrolytic cells employ an ion permeable and liquid impermeable ion exchange membrane to separate the anode and cathode chambers. In such electrolytic cells, chlorine is released at the anode and sodium hydroxide is formed in the cathode chamber.

The diaphragms of the prior art are generally satisfactory; however, there is a need for an electrolyte permeable, non-asbestos containing diaphragm suitable for use in electrolytic cells.

SUMMARY OF THE INVENTION

An electrolytic cell, including an alkali metal ion and electrolyte permeable polytetrafluoroethylene diaphragm, to produce chlorine and an alkali metal hydroxide has been developed. The electrolytic cell comprises an anode compartment suited to contain an anolyte such as an aqueous solution or mixture of an alkali metal chloride, for example, sodium chloride. A cathode compartment adapted to contain a catholyte containing the hydroxide of the alkali metal is spaced apart from the anode compartment by the permeable polytetrafluoroethylene diaphragm.

An anode is suitably positioned within the anode compartment and a cathode is suitably positioned within the cathode compartment. A means to supply a direct current to the anode and the cathode is suitably electrically connected to these electrodes. The electrolytic cell further includes a means to remove the chlorine produced at the anode from the anode compartment and a means to remove the alkali metal hydroxide from the cathode compartment.

The diaphragm separating the anode and cathode compartments is suited to pass a portion of the electrolyte and ions of at least the alkaline metal from the anode compartment to the cathode compartment. The diaphragm is suitably positioned in the electrolytic cell to substantially entirely separate the anode compartment from the cathode compartment. The electrolyte permeable and wettable, porous polytetrafluroroethylene diaphragm is a porous sheet with a thickness of from about 5 to about 100 mils (1 mil equals 1/1000 inch), an average pore size of from about 0.1 to about 100 microns, longitudal and transverse tensile strengths of from about 100 to about 1000 pounds per square inch (psi), a gas permeability of from about 1 to about 50 seconds, and a liquid permeability factor of from about 1 to about 60. The "liquid permeability factor" is herein defined as the water head in inches above the diaphragm portion measured required to cause an average of 1 cubic centimeter of water (at 30° C. and standard atmospheric pressure) to pass through a one square centimeter portion of the diaphragm in one hour. The gas permeability is determined substantially in accord with ASTM Standard D-726-58 (Reapproved 1965), method B, save for the air pressure which is 4 ounces. Said ASTM Standard is incorporated herein by reference.

DESCRIPTION OF THE PREFERRED EMBODIMENTS

An electrolytic cell includes an anode compartment with an anode positioned therein juxtaposed and spaced apart from a cathode compartment with a cathode positioned therein. The anode compartment is spaced apart from the cathode compartment by a diaphragm capable of passing at least alkali metal ions from the anode compartment to the cathode compartment. The electrolytic cell further includes a source of alkali metal chloride brine and a means to introduce or feed the brine into the anode compartment. A gaseous chlorine removal means, such as a pipe, is suitably connected to the anode compartment to afford removal of gaseous chlorine without substantial loss of chlorine to the ambient atmosphere.

During operation of the electrolytic cell the catholyte contains increasing concentrations of an alkali metal hydroxide, such as sodium hydroxide, which for efficient operation should be removed from the cathode compartment to reduce the hydroxide concentration. For this purpose an alkali metal hydroxide removal means such as pipe is in combination with the cathode compartment. If gaseous hydrogen is formed during electrolysis, a hydrogen removal means, such as a pipe, is suitably connected to the cathod compartment to afford removal of gaseous hydrogen.

The cathode is preferably a member with at least the surface composed of a substantially inert material. For example, the cathode can be made of steel, titanium, tantalum, tungsten and the like.

The anode is constructed of a material such as graphite or what is known in the art as a dimensionally stable anode such as titanium or tantalum coated or plated with materials including, for example, at least one metal or oxide of the platinum group metals including Ru, Rh, Pd, Ag, Os, Ir, Pt, and Au.

A source of electrical energy is electrically connected to an energy transmission or carrying means such as aluminum or copper conduit, for example, a bus bar or cable, to transmit direct electrical current to the anode and the cathode.

The herein described diaphragm satisfactorily serves to space apart oppositely charged electrodes in the electrolytic cell to produce chlorine from an aqueous solution of an alkali metal chloride, such as sodium chloride. The particular diaphragm employed replaces the asbestos type diaphragms common to the well-known chlorine-caustic electrolytic cells. For example, a porous polytetrafluoroethylene mat or sheet meeting the herein described parameters can be sealably formed into a pocket-like structure and positioned around what is known in the art as a "pocket cathode" to replace an asbestos diaphragm as described in, for example, U.S. Pat. No. 2,858,263. If desired, the diaphragm can be positioned between and spaced apart from both the anode and the cathode as in, for example, the electrolytic cell of U.S. Pat. No. 3,923,628.

More consistent cell operation with the porous diaphragm can be achieved with an about 40 to about 70 mil thick porous polytetrafluorethylene sheet with an average pore size of from about 1 to about 20 microns. The pores are preferably substantially uniformly distributed throughout the diaphragm and interconnectingly extend through the sheet to provide a gas permability of from about 8 to about 20 seconds. Furthermore, the size of the pores throughout the diaphragm are such that about 80 to about 100 percent, and preferably about 85 to about 95 percent of the pores are of a size within two orders of magnitude from each other; for example, when the average pore size is 1 micron about 80 to about 100 percent of the pores are within the size range of 0.1 to 10 microns.

The diaphragm is from about 60 to about 90 and preferably from about 70 to about 80 percent porous. In addition to the hereinbefore delineated parameters, the diaphragm must pass sufficient electrolyte from the anode compartment to the cathode compartment to maintain catholyte within the cathode compartment during operation of the cell. A liquid permeability factor of about 1 to about 60, and preferably about 5 to about 25, has been determined to be satisfactory.

The diaphragm should have sufficient strength to retain the desired structure, i.e., permeability, pore size, thickness and shape when in use for extended time periods in the corrosive environment and temperatures present in an operating electrolytic cell. Polytetrafluorethylene sheet with tensile strengths of about 150 to about 700 psi and more preferably about 250 to about 600 psi is satisfactory.

An electrolytic cell employing the porous tetrafluoroethylene diaphragm operates in substantially the same manner as does a well-known cell with an asbestos diaphragm. A brine containing a dissolved salt, such as sodium chloride is fed into the anode compartment wherein it flows through the porous polytetrafluoroethylene diaphragm into the cathode compartment. Sufficient electrical energy is applied to the anode and cathode to release gaseous chlorine at the anode and to form the alkali metal hydroxide in the cathode compartment. The gaseous chlorine, alkali metal hydroxide and gaseous hydrogen, if present, are suitably removed and recovered from the cell by means known to those skilled in the art.

The following examples further illustrate the invention:

EXAMPLE 1

Fibrous polytetrafluoroethylene sheet with the following characteristics was obtained from Fluorotechniques of Bellport, New York, under its product designation Micro-O MR360.

A 9 inch by 9 inch portion of the porous sheet was installed as a diaphragm in a laboratory electrolytic cell for producing chlorine and sodium hydroxide from an aqueous sodium chloride solution. The 9 inch by 9 inch by 3 inch cell included two methyl acrylate plastic members adapted to hold the anolyte and catholyte. The porous sheet portion was positioned between the plastic members to obtain an effective diaphragm area of 6 inches by 5 inches and retained in place by means of suitably applied pressure. The periphery of the porous sheet acted as a seal between the plastic members to prevent leakage of the anolyte and catholyte from the cell. The cell further included a 6 inch by 5 inch by 1 inch thick graphite anode in the anode compartment and a 6 inch by 5 inch perforated steel cathode. Suitable means were provided to feed an aqueous sodium chloride solution and electric current (direct current) to the appropriate portions of the cell. Tubing was connected to the anode and cathode compartments to withdraw an aqueous sodium hydroxide solution and gaseous chlorine and hydrogen from the cell as necessary.

The diaphragm was treated as follows to make it electrolyte wettable. The assembled cell was filled with a saturated methyl alcohol solution and permitted to flow through the cell for a period of one hour. The initial alcohol head over the cell was 36 inches. This alcohol flowing step was repeated a second time whereafter the alcohol head was readjusted to 36 inches and the cell filled with alcohol. The so-filled cell remained static overnight. The following day, the alcohol was removed from the cell and the cell was washed to remove traces of alcohol by flushing with distilled water for 30 minutes. The diaphragm treating procedure can also be carried out using, for example, acetone, ethyl ether or an aliphatic alcohol with 1 to 5 carbon atoms. Preferably the wetting agent is methanol or an aqueous saturated isobutyl alcohol solution.

The cell was then filled with a saturated sodium chloride solution and the flow rate of the solution through the cell was determined to be 0.82 cubic centimeters per hour per square centimeter of diaphragm surface ($cc/hr/cm^2$), when the solution head was 14 inches.

The average, or effective, pore size of the porous polytetrafluoroethylene diaphragm had previously been determined to be 3 microns by ascertaining the size of the smallest particle retained on the polytetrafluoroethylene surface when it acts as a filter. The pore size has also been determined by standard mercury intrusion techniques. The diaphragm was 60 mils thick and was 70 to 80 percent porous. In operation of the laboratory cell a sodium chloride solution was continuously fed to the anode compartment and an aqueous solution containing 123 grams per liter (gpl) of sodium hydroxide was continuously removed from the cathode compartment. Gaseous chlorine and hydrogen were removed through suitable tubes. The cell temperature including the catholyte and acidic anolyte was maintained at 38° C. The caustic, i.e., sodium hydroxide, current efficiency was 83.9 percent when the cell voltage was 3.45 volts and the anode current density was 0.5 amperes per square inch ($amp/in^2$).

EXAMPLE 1*a*

After about four weeks of operation the electrolyte flow through the cell and diaphragm of Example 1 was 0.77 $cc/hr/cm^2$ when the sodium chloride solution feed head was 34 inches. The caustic current efficiency was 91.8 percent when the voltage was 3.09 volts, anode current density 0.5 $amp/in^2$ and the catholyte contained 138 gpl sodium hydroxide.

EXAMPLE 2

A cell with a 50 mils thick, 70 to 80 percent porous polytetrafluoroethylene diaphragm with an average pore size of 1 micron was treated with isobutyl alcohol and operated with an aqueous solution containing about 216 gpi sodium chloride substantially as in Example 1. The transverse and longitudinal tensile strengths of the diaphragm were 495 and 565 psi, respectively. The porous polytetrafluoroethylene is available from Fluorotechniques as Micro-O M7R1000. The flow rate of the electrolyte through the diaphragm was 0.77 cc/hr/cm$^2$ when the head was 21 inches. Caustic current efficiency was 77.3 percent when cell voltage was 3.50 volts and the catholyte contained 116.8 gpl sodium hydroxide.

After fifty days of operation the electrolyte flow rate through the diaphragm was 0.68 when the head was 38 inches; the catholyte contained 144 gpl sodium hydroxide; and the caustic current efficiency was 85 percent when the cell temperature was 40° C. and all voltage 3.92 volts.

EXAMPLE 3

A cell with a 100 mils thick, 70 to 80 percent porous polytetrafluoroethylene diaphragm with an average pore size of 25 micron was treated with methyl alcohol and operated substantially as in Example 1. The porous polytetrafluoroethylene is available from Fluorotechniques as Micro-O M8R2500. The flow rate of the electrolyte through the diaphragm was 0.94 cc/hr/cm$^2$ when the head was 15 inches. Caustic current efficiency was 93.5 percent when cell voltage was 3.3 volts, temperature 70° C. and the catholyte contained 112 gpl sodium hydroxide.

After fifty days of operation the electrolyte flow rate through the diaphragm was 0.83 when the head was 15 inches; the catholyte contained 121.6 gpl sodium hydroxide; and the caustic current efficiency was 86.3 percent when the cell temperature was 78° C. and cell voltage 3.34 volts.

EXAMPLE 4

Substantially as described in Example 1 a cell is operated using a 45 mil thick diaphragm having an average pore size of 6 microns, a gas permeability of 12 seconds and a liquid permeability factor of 20. About 90 percent of the pores are of a size within two orders of magnitude of each other. The gas permeability is determined using a Gurley Densometer No. 4120 with a 4 ounce cylinder. Chlorine is satisfactorily produced with the electrolytic cell.

What is claimed is:

1. An electrolytic cell for producing chlorine and an alkali metal hydroxide from an alkali metal chloride comprising:

an anode compartment adapted to contain an anolyte containing an alkali metal chloride;

a cathode compartment adapted to contain a catholyte containing an alkali metal hydroxide;

an anode positioned in said anode compartment;

a cathode positioned in said cathode compartment and spaced apart from said anode by a diaphragm;

a porous polytetrafluoroethylene diaphragm with a thickness of from about 5 to about 100 mils, an average pore size of from about 0.1 to about 100 microns, a gas permeability of from about 1 to about 50 seconds, a liquid permeability factor of from about 1 to about 60, and a tensile strength of from about 100 to about 1000 pounds per square inch;

a means to feed the anolyte to said anode compartment;

a means to remove the chlorine from said anode compartment;

a means to remove the alkali metal hydroxide from said cathode compartment;

and a means to supply electrical energy to said anode and said cathode.

2. The apparatus of claim 1 wherein from about 80 to about 100 percent of the pores in said diaphragm have an area within two orders of magnitude of each other.

3. The apparatus of claim 1 wherein said diaphragm is about 40 to about 70 mils thick.

4. The apparatus of claim 1 wherein said diaphragm is from about 60 to about 90 percent porous.

5. The apparatus of claim 1 wherein the liquid permeability factor of said diaphragm is from about 5 to about 25.

6. The apparatus of claim 1 wherein the thickness of said diaphragm is about 40 to about 70 mils, the average pore size dimension is about 1 to about 20 microns, the gas permeability is from about 8 to about 20 seconds, the liquid permeability factor is from about 5 to about 25, the tensile strength is about 150 to about 700, said diaphragm is about 70 to about 80 percent porous, and about 85 to about 95 percent of the pores are of a size within two orders of magnitude from each other.

7. The apparatus of claim 6 wherein the tensile strength of said diaphragm is about 250 to about 600 pounds per square inch.

8. The apparatus of claim 1 wherein the diaphragm is porous, hydrophilic polytetrafluoroethylene.

9. The apparatus of claim 6 wherein the diaphragm is porous, hydrophilic polytetrafluoroethylene.

10. The method of claim 7 wherein the porous polytetrafluoroethylene is pretreated to provide an electrolyte wettable diaphragm.

11. The apparatus of claim 10 wherein the porous polytetrafluoroethylene is pretreated with an agent selected from acetone, ethyl ether or an aliphatic alcohol with 1 to 10 carbon atoms.

12. The apparatus of claim 10 wherein the porous polytetrafluoroethylene is pretreated with methanol or an aqueous saturated isobutyl alcohol solution.

* * * * *